US005935048A

United States Patent [19]

Krull

[11] Patent Number: 5,935,048

[45] Date of Patent: Aug. 10, 1999

[54] WEIGHT LIFTING EXERCISE APPARATUS

[76] Inventor: Mark A. Krull, 1705 E. Ridge Ct., Northfield, Minn. 55057

[21] Appl. No.: 09/149,181

[22] Filed: Sep. 8, 1998

[51] Int. Cl.[6] ..... A63B 21/06

[52] U.S. Cl. ..... 482/98; 482/99

[58] Field of Search ..... 482/94, 98–103

[56] References Cited

U.S. PATENT DOCUMENTS 4,765,611 8/1988 MacMillan ..... 482/98
4,809,973 3/1989 Johns ..... 482/98
4,834,365 6/1989 Jones ..... 482/99

FOREIGN PATENT DOCUMENTS 2613237 10/1988 France ..... 482/98

*Primary Examiner*—John Mulcahy

[57] ABSTRACT

Supplemental weights are disposed above a weight stack and are selectively movable along a limited path onto the top plate in the weight stack. The supplemental weights may be moved into and out of a storage position by rotation and/or translation relative to the weight stack frame.

23 Claims, 17 Drawing Sheets

WEIGHT LIFTING EXERCISE APPARATUS

FIELD OF THE INVENTION

The present invention relates to exercise equipment and more particularly, to exercise equipment that uses a selectively variable number of weights to resist exercise motion.

BACKGROUND OF THE INVENTION

Exercise weight stacks are known in the art. Generally speaking, weights are arranged in a stack and movably mounted on guide rods. A selector rod is connected to a desired number of weights by means of a pin. The selector rod and any selected weights are connected to a force receiving member by means of a cable and move upward in response to exercise movement.

Although exercise weight stacks are prevalent in the exercise industry, they nonetheless suffer from certain shortcomings. For example, in order to provide a sufficiently large amount of weight at a reasonable cost, equipment manufacturers must use weights of relatively large mass. As a result, the weight being lifted cannot be adjusted in small increments.

Attempts have been made to address the issue of incremental adjustments. One such effort involves the provision of a second, adjacent weight stack comprising weights which weigh a fraction of the weights in the other or primary stack. A problem with this approach is that it adds significantly to the cost of the equipment. Another effort involves the provision of a half-weight, which weighs one-half the weight of each weight in the stack, and which is selectively movable from a peg on the frame onto an aligned peg on the top plate of the stack. This approach not only creates a balance problem during movement of the selected weights, but it also increases the potential for injury due to the proximity of the two pegs and their movement relative to one another.

SUMMARY OF THE INVENTION

The present invention provides an exercise apparatus which includes a frame; a stack of weight plates, including a top plate, mounted on the frame and movable between a lowermost position and an uppermost position; a connector interconnected between a force receiving member and a desired number of plates in the stack; and a supplemental weight movable along a substantially fixed path between a first location, supported by the frame above the lowermost position and outside a space defined between the lowermost position and the uppermost position, and a second location, supported on the top plate and inside the space.

The present invention provides a variety of alternatives for supporting the supplemental weight and/or selecting the supplemental weight. The various embodiments of the present invention store the supplemental weight outside of harm's way yet prevent outright removal of the supplemental weight. Many of the features and advantages of the present invention will become apparent from the more detailed description that follows.

BRIEF DESCRIPTION OF THE FIGURES OF THE DRAWING

With reference to the Figures of the Drawing, wherein like numerals represent like parts and assemblies throughout the several views.

DETAILED DESCRIPTION OF A PREFERRED EMBODIMENT

The present invention provides methods and apparatus related to incremental adjustment of weight stack resistance. More specficially, an otherwise conventional weight stack machine is provided with supplemental weights which weigh a fraction of the weights in the stack and are selectively movable onto the top plate of the stack.

Figure 1:
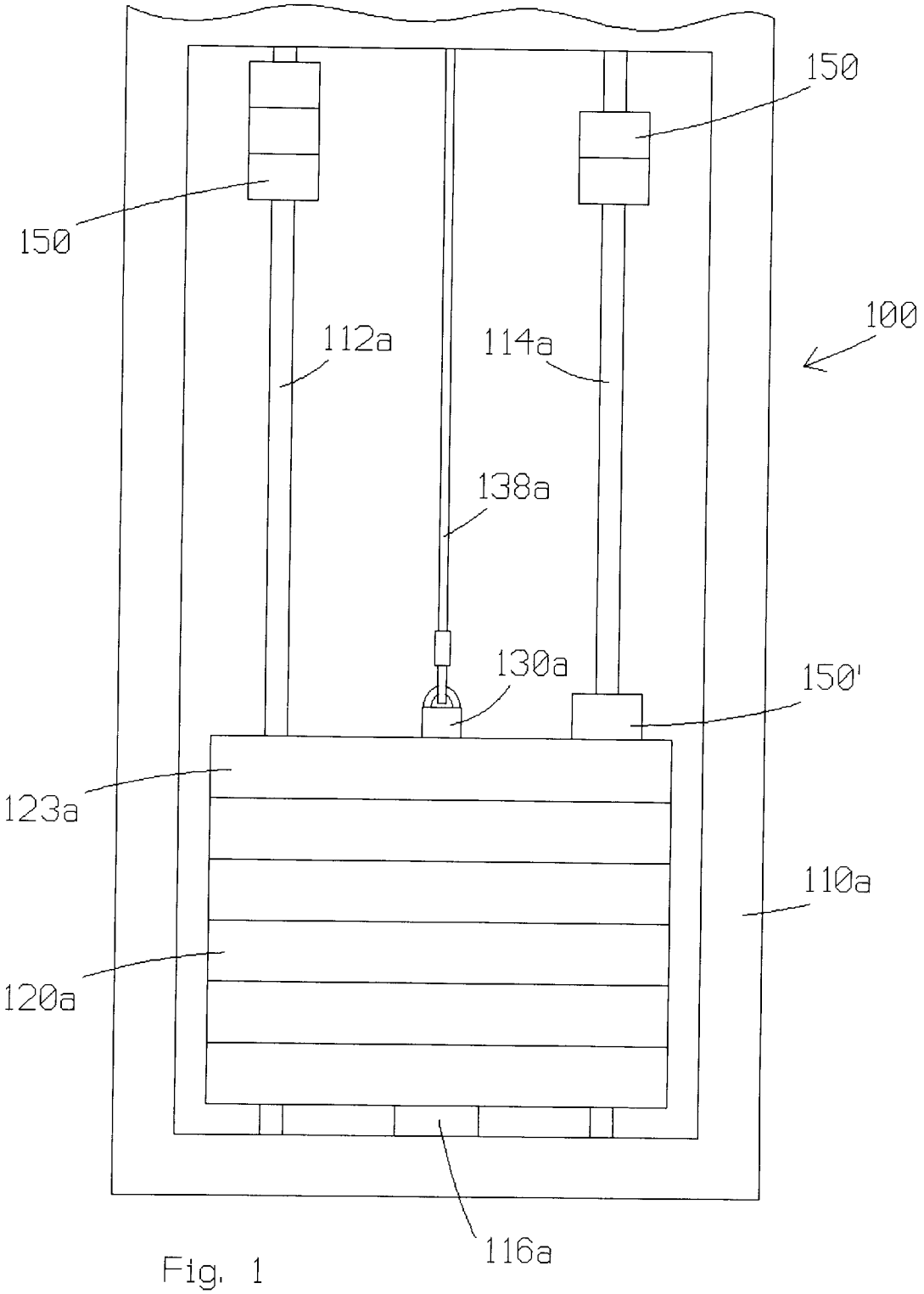
FIG. 1 is a partially fragmented, front view of a first exercise apparatus constructed according to the principles of the present invention.

FIG. 1 shows a first weight stack machine 100 which has been modified in accordance with the principles of the present invention. The machine 100 includes a frame 110*a* designed to rest upon a floor surface. First and second guide rods 112*a* and 114*a* extend vertically between lower and upper ends of the frame 110*a*. A top plate 123*a* and underlying weight plates 120*a* are movably mounted on the guide rods 112*a* and 114*a*. When not in use, the plates 123*a* and 120*a* rest against a shock absorbing member 116*a* on the lower end of the frame 110*a*.

A selector rod 130*a* extends through the plates 123*a* and 120*a* and is selectively connected to any desired plate 120*a* by a selector pin or other means known in the art. A cable 138*a* extends from an upper end of the selector rod 130*a* to one or more force receiving members which operate in a manner known in the art. As a result, movement of a force receiving member is resisted by gravity acting on the selected number of plates.

Figure 2:
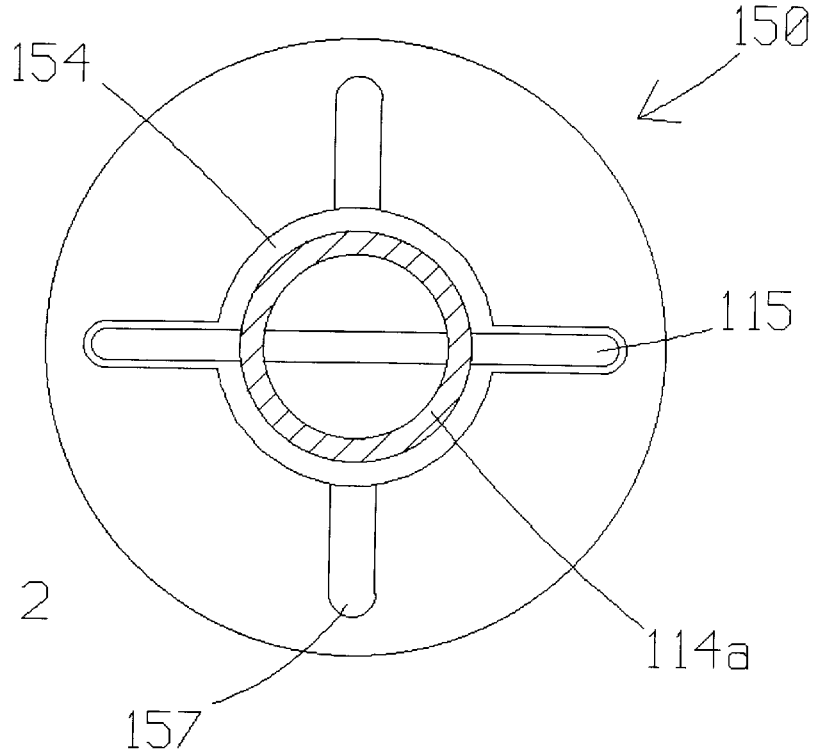
FIG. 2 is a partially sectioned, bottom view of a guide rod and supplemental weight on the exercise apparatus of FIG. 1.
Figure 3:
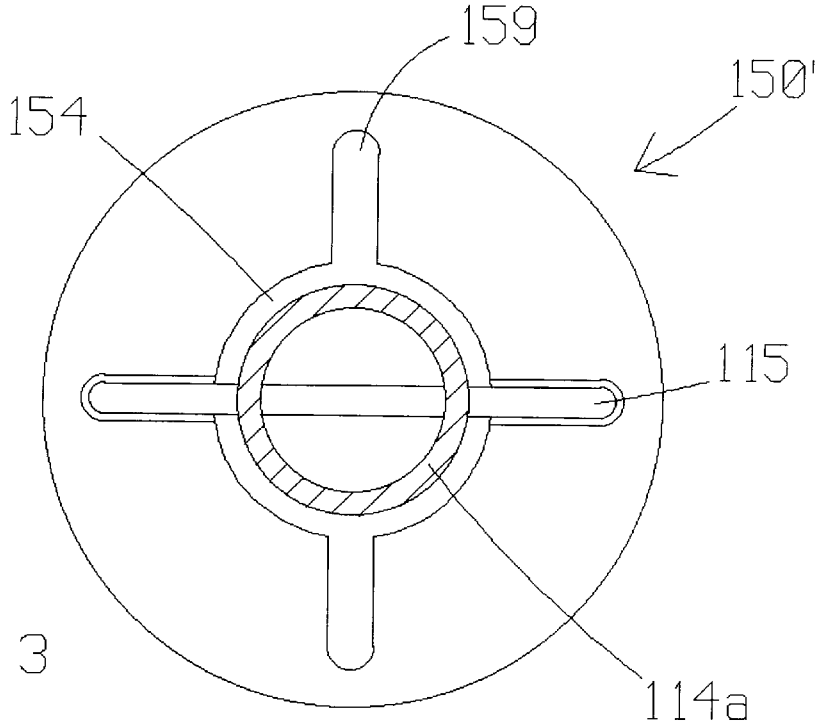
FIG. 3 is a partially sectioned, bottom view of the guide rod and supplemental weight of FIG. 2, the latter having been rotated ninety degrees relative to the former.

In accordance with the present invention, supplemental weights 150 and 150' are movably mounted on the guide rods 112*a* and 114*a* above the top plate 123*a*. As shown in FIGS. 2–3 (where the depicted guide rod 114*a* is representative of the other guide rod 112*a*), a pin 115 is rigidly secured to the guide rod 114*a* and extends perpendicular relative thereto.

A hole 154 is formed through each of the weights 150 and 150' to accommodate one of the guide rods 112*a* or 114*a*. A transverse notch 157 is formed in the bottom of each weight 150 or 150' to engage the pin 115 when the weight 150 or 150' is oriented as shown in FIG. 3. A transverse slot 159, which extends perpendicular to the notch 157, is formed through each weight 150 or 150' to provide clearance for the pin 115 when the weight 150 or 150' is oriented as shown in FIG. 2. The weight 150' shown in FIG. 1 was rotated ninety degrees relative to the weights 150 in order to descend the guide rod 114*a*.

Figure 4:
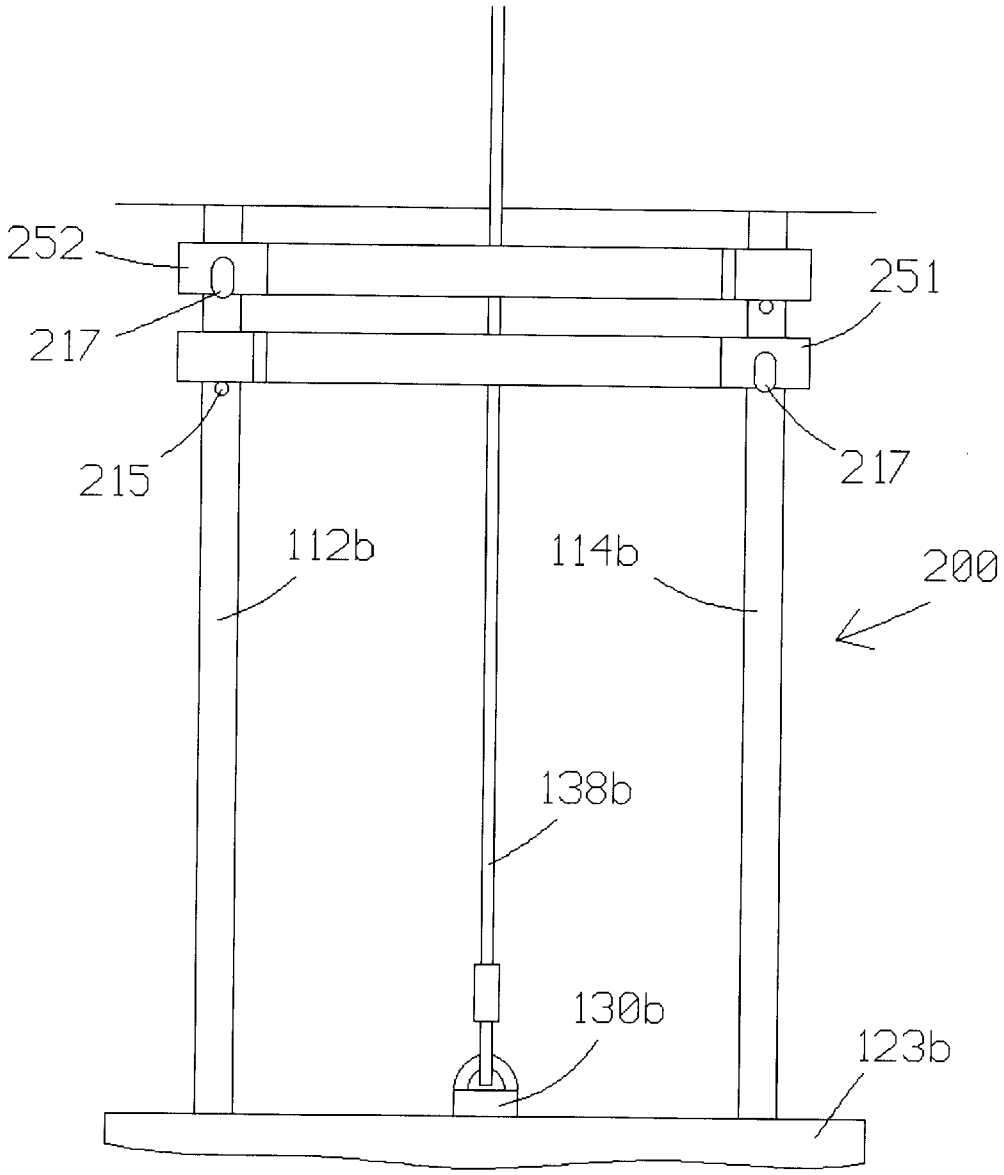
FIG. 4 is a partially fragmented, front view of a second exercise apparatus constructed according to the principles of the present invention.

FIG. 4 shows a second weight stack machine 200 which has been modified in accordance with the principles of the present invention. The machine 200 similarly includes a weight stack, including top plate 123*b*, movably mounted on guide rods 112*b* and 114*b*. A selector rod 130*b* extends through the weight stack and is connected to a force receiving member by means of cable 138*b*.

Figure 5:
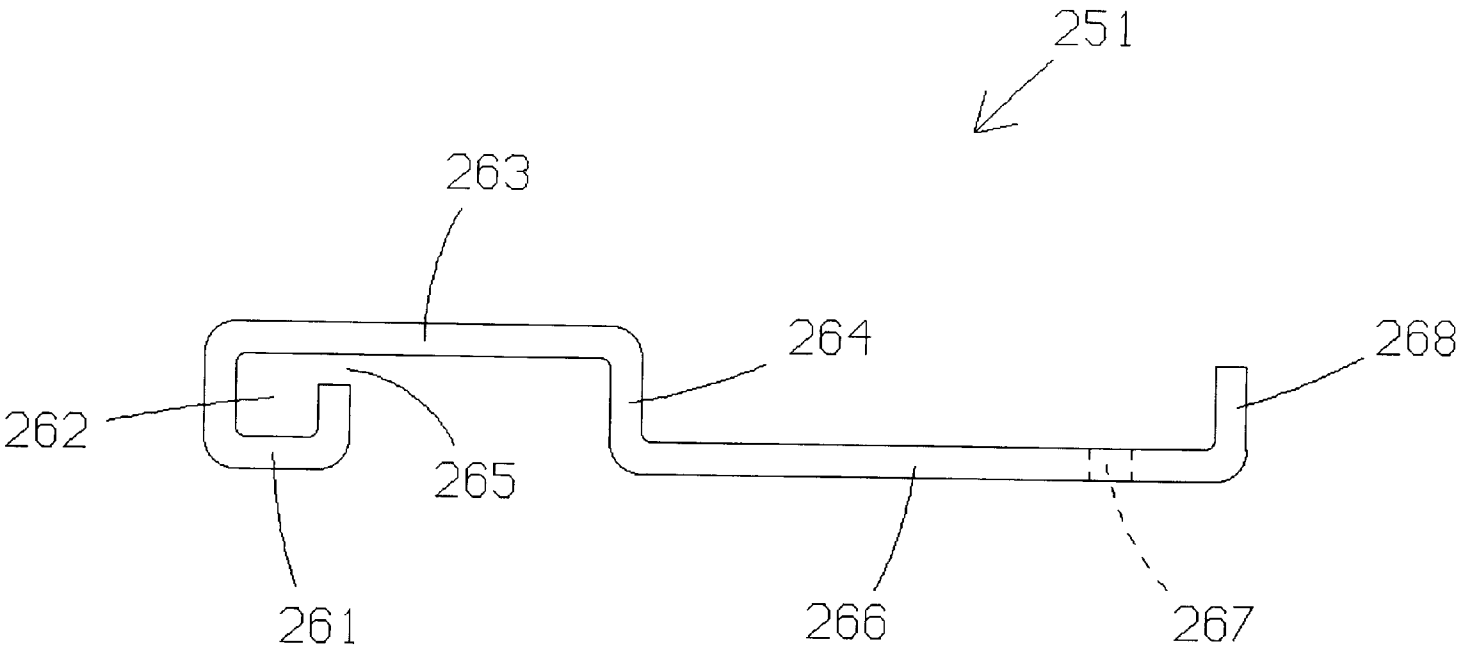
FIG. 5 is a top view of a supplemental weight on the exercise apparatus of FIG. 4.

Supplemental weights 251 and 252 are movably mounted on the guide rods 112*b* and 114*b* above the top plate 123*b*. As shown in FIG. 5 (where the depicted weight 251 is a mirror image of the other weight 252), the weight 251 is a bar that has been bent or otherwise formed to interact with the guide rods 112*b* and 114*b* and not interfere with the selector rod 130*b* and/or the cable 138*b*.

A first end 261 of the bar 251 forms a substantially closed loop which is interrupted by a slot 265 disposed between the end 261 and an intermediate segment 263. The loop bounds an opening 262 sufficient in size to accommodate the guide rod 112*b*. A central segment 264 of the bar 251 is interconnected transversely between the intermediate segment 263 and an opposite intermediate segment 266. The segments 263 and 266 are different lengths to space the segment 264 apart from the selector rod 130*b* and cable 138*b*. A notch 267 is formed in the underside of the segment 266, proximate the second, opposite end 268, for reasons explained below.

When the weight 251 is arranged as shown in FIG. 4, the first end 261 rests upon a transversely extending pin 215 rigidly secured to the guide rod 112*b*, and the segment 266 rests upon a transversely extending hook 217 rigidly secured to the guide rod 114*b*. The hook 217 has a transversely extending shaft which nests inside the notch 267, and an upwardly extending end which discourages rotation of the weight 251 about the guide rod 112*b*. The weight 251 is lowered onto the top plate 123*b* by lifting the weight 251 off the hook 217 and rotating the weight 251 until the slot 265 aligns with the pin 215. An advantage of this embodiment (and certain other embodiments described herein) is that the mass of each of the weights 251 and 252 is relatively evenly distributed across the top plate 123*b*.

Figure 6:
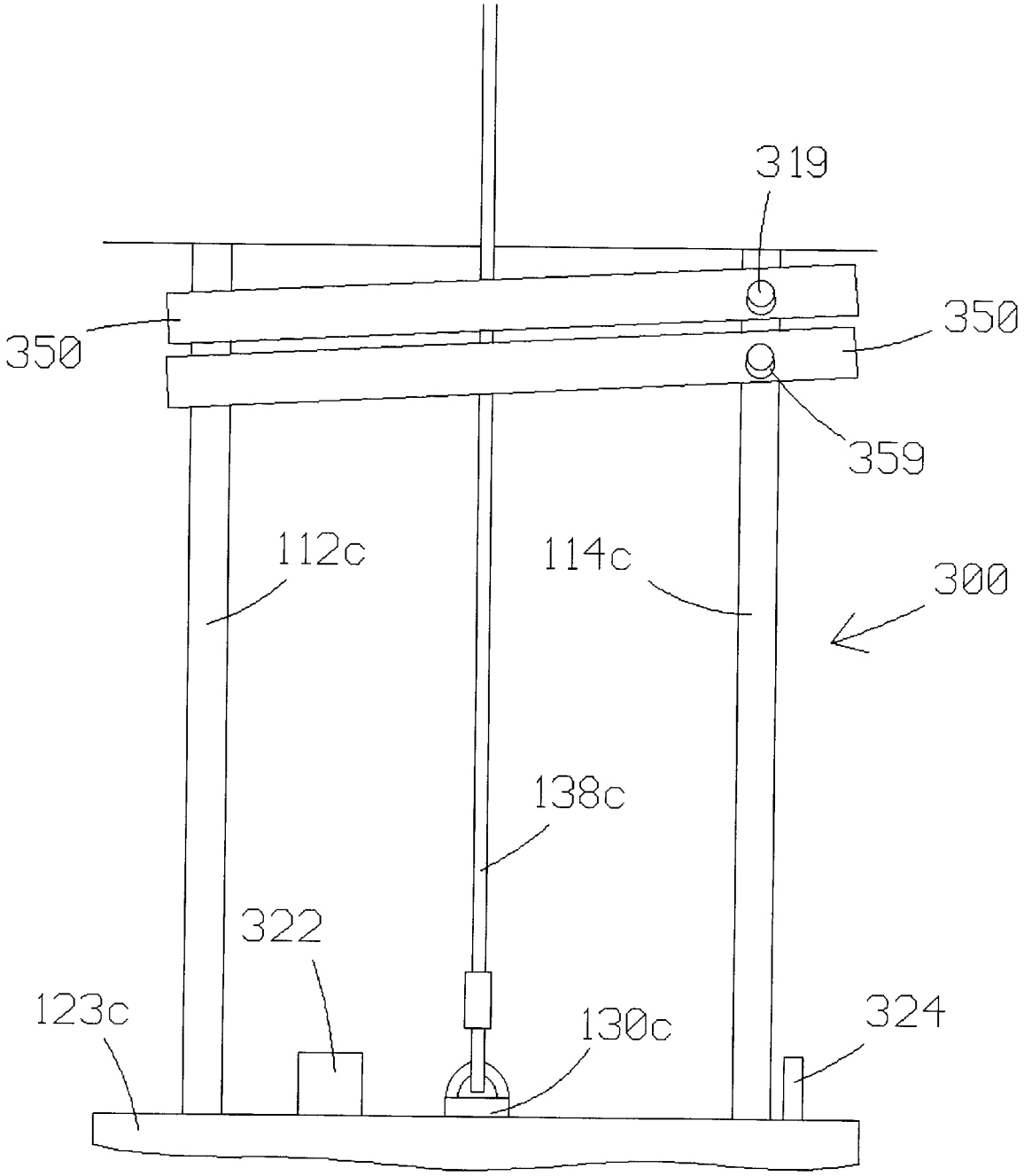
FIG. 6 is a partially fragmented, front view of a third exercise apparatus constructed according to the principles of the present invention.

FIG. 6 shows a third weight stack machine 300 which has been modified in accordance with the principles of the present invention. The machine 300 similarly includes a weight stack, including top plate 123*c*, movably mounted on guide rods 112*c* and 114*c*. A selector rod 130*c* extends through the weight stack and is connected to a force receiving member by means of cable 138*c*.

Figure 7:
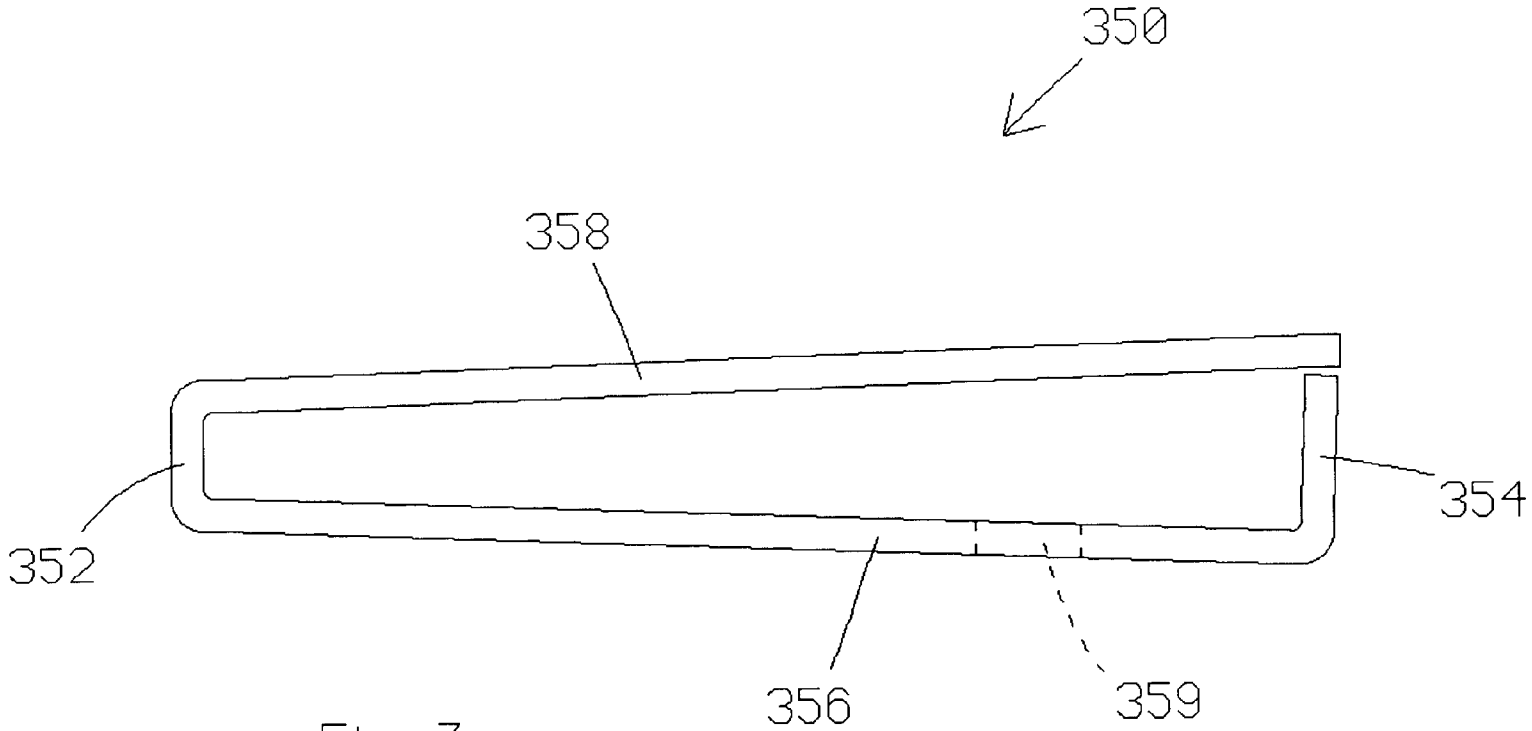
FIG. 7 is a top view of a supplemental weight on the exercise apparatus of FIG. 6.

Supplemental weights 350 are movably mounted on the guide rods 112*c* and 114*c* above the top plate 123*c*. As shown in FIG. 7, each weight 350 is a bar that has been bent or otherwise formed to interact with the guide rods 112*c* and 114*c* and not interfere with the selector rod 130*c* and/or the cable 138*c*.

Each bar 350 may be described as a substantially closed loop having relatively short ends 352 and 354 and relatively long sides 356 and 358. Each loop is sized and configured to fit around both guide rods 112*c* and 114*c*. A hole 359 is formed in the front side 356 of the bar 350, proximate the relatively longer end 354, for reasons explained below.

When the weight 350 is arranged as shown in FIG. 6, the second end 354 is supported by a transversely extending bolt 319 rigidly secured to the guide rod 114*c*, and the first end 352 rests against the guide rod 112*c*. The bolt 319 has a shaft which extends through the hole 359, and a larger diameter head which discourages rotation of the weight 350 about the guide rod 112*c*. The weight 350 is lowered onto the top plate 123*c* by lifting the weight 350 off the bolt 319 and rotating the weight 350 until the front side 356 clears the head of the bolt 319.

Supports 322 and 324 are provided on the top plate 123*c* to stabilize the weights 350 during exercise. The support 322 has a trapezoidal shape which engages the sides 356 and 358 to discourage movement of the end 352 toward the guide rod 114*c*, and the support 324 has a rectangular shape which engages the end 354 to discourage movement of the end 354 toward the guide rod 112*c*.

Figure 8:
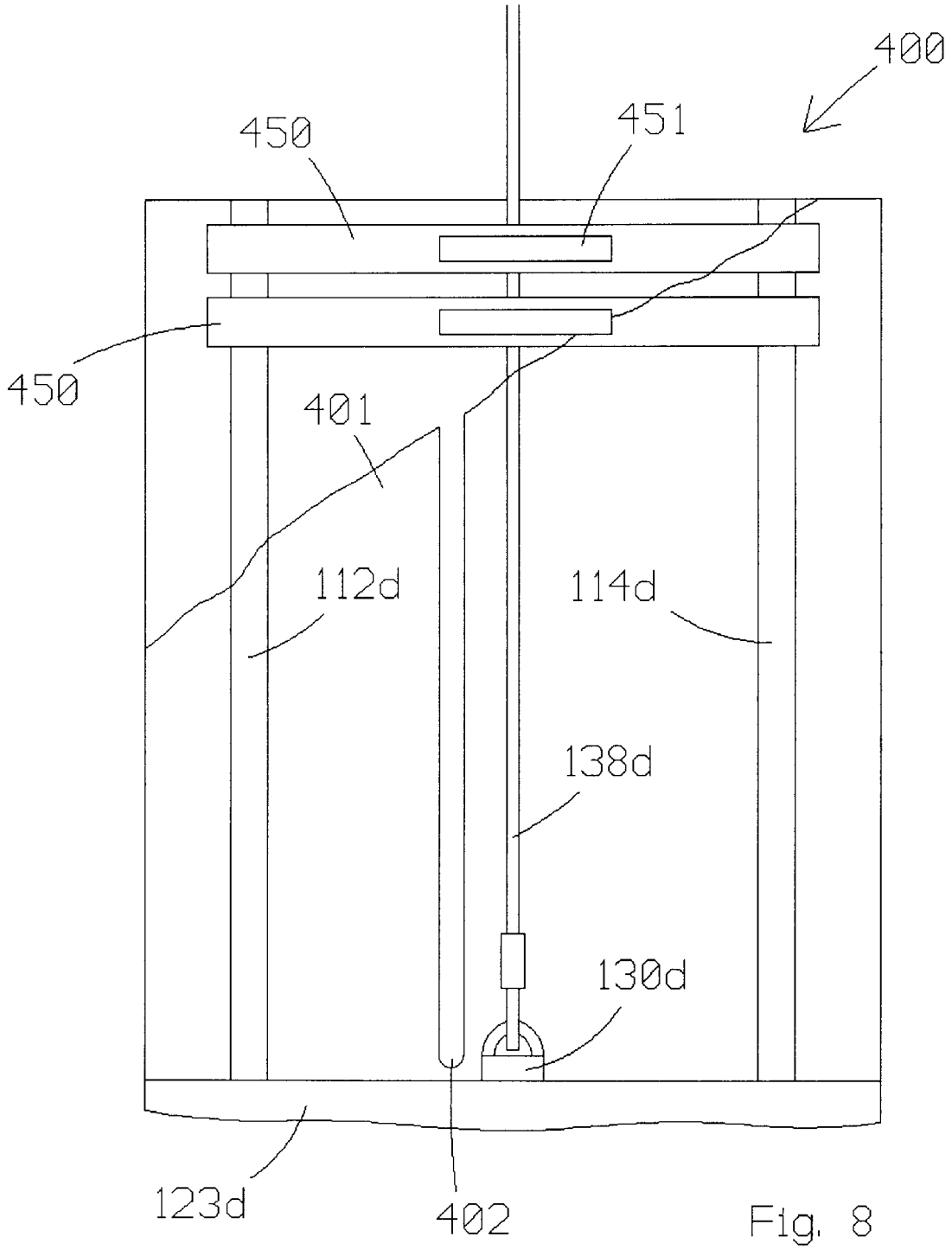
FIG. 8 is a partially fragmented, front view of a fourth exercise apparatus constructed according to the principles of the present invention.

FIG. 8 shows a fourth weight stack machine 400 which has been modified in accordance with the principles of the present invention. The machine 400 similarly includes a weight stack, including top plate 123*d*, movably mounted on guide rods 112*d* and 114*d*. A selector rod 130*d* extends through the weight stack and is connected to a force receiving member by means of cable 138*d*.

Figure 9:
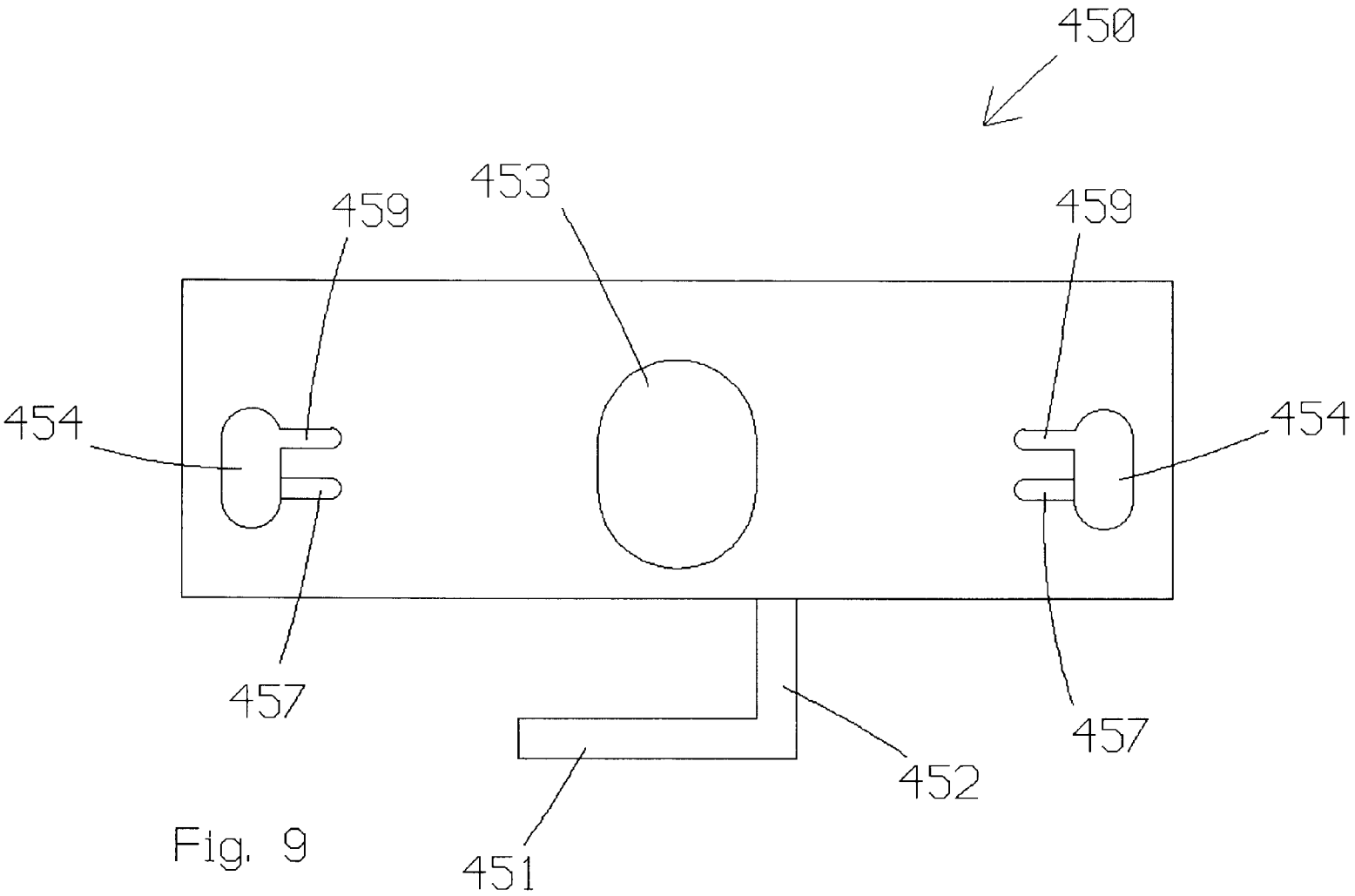
FIG. 9 is a bottom view of a supplemental weight on the exercise apparatus of FIG. 8.

Supplemental weights 450 are movably mounted on the guide rods 112*d* and 114*d* above the top plate 123*d*. Also, a safety shield 401 is provided to substantially cover or enclose the moving parts of the apparatus 400. A slot 402 is provided in the shield 401 to facilitate manipulation of the supplemental weights 450. As shown in FIG. 9, a shaft 452 is sized and configured to extend through the slot 402 and connect a respective weight 450 to a respective handle 451 disposed on the near side of the shield 401.

A central hole 453 is formed through the weight 450 to provide clearance for the cable 138*d*. Smaller oval holes 454 are formed through the weight 450 to accommodate the guide rods 112*d* and 114*d*. Pins (not shown) extend transversely from respective guide rods 112*d* and 114*d* and toward one another. Transverse notches 457 are formed in the bottom of the weight 450 to engage the pins when the weight 450 occupies a first position relative to the guide rods 112*d* and 114*d*. Transverse slots 459 are formed through the weight 450 to accommodate the pins when the weight 450 occupies a second, transversely displaced position relative to the guide rods 112*d* and 114*d*.

Each weight 450 is lowered onto the top plate 123*d* by pulling the handle 451 toward the reader and allowing the weight 450 to descend. The shield 401 may be made to cooperate with the shaft 452 in a manner which controls descent of the weight 450 but does not interfere with ascent of the weight 450. Also, the weights 450 (as well as the weights on other embodiments) may be coated with a shock absorbing material or otherwise modified to reduce impact and/or noise during operation.

Figure 10:
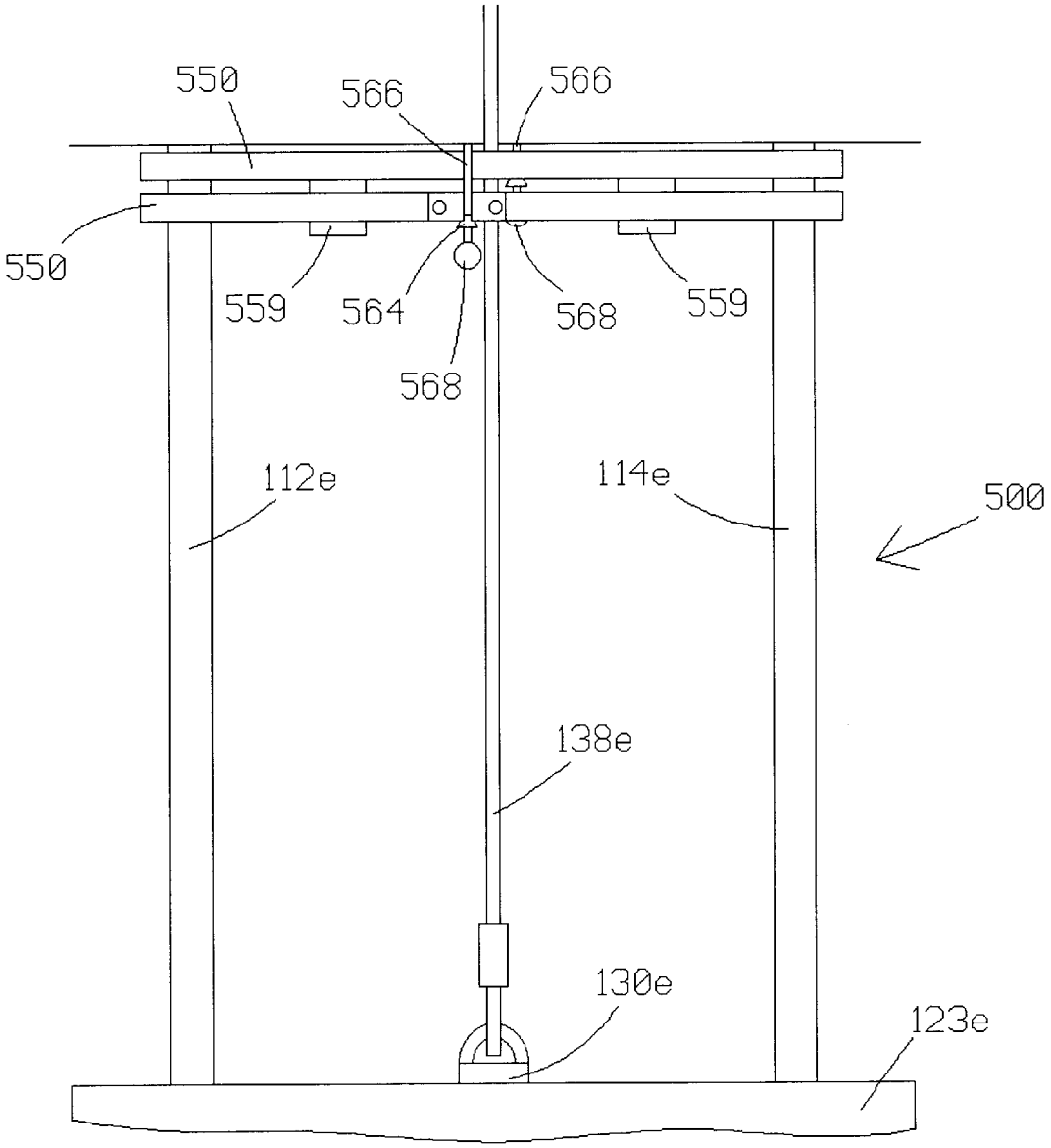
FIG. 10 is a partially fragmented, front view of a fifth exercise apparatus constructed according to the principles of the present invention.

FIG. 10 shows a fifth weight stack machine 500 which has been modified in accordance with the principles of the present invention. The machine 500 similarly includes a weight stack, including top plate 123*e*, movably mounted on guide rods 112*e* and 114*e*. A selector rod 130*e* extends through the weight stack and is connected to a force receiving member by means of cable 138*e*.

Figure 11:
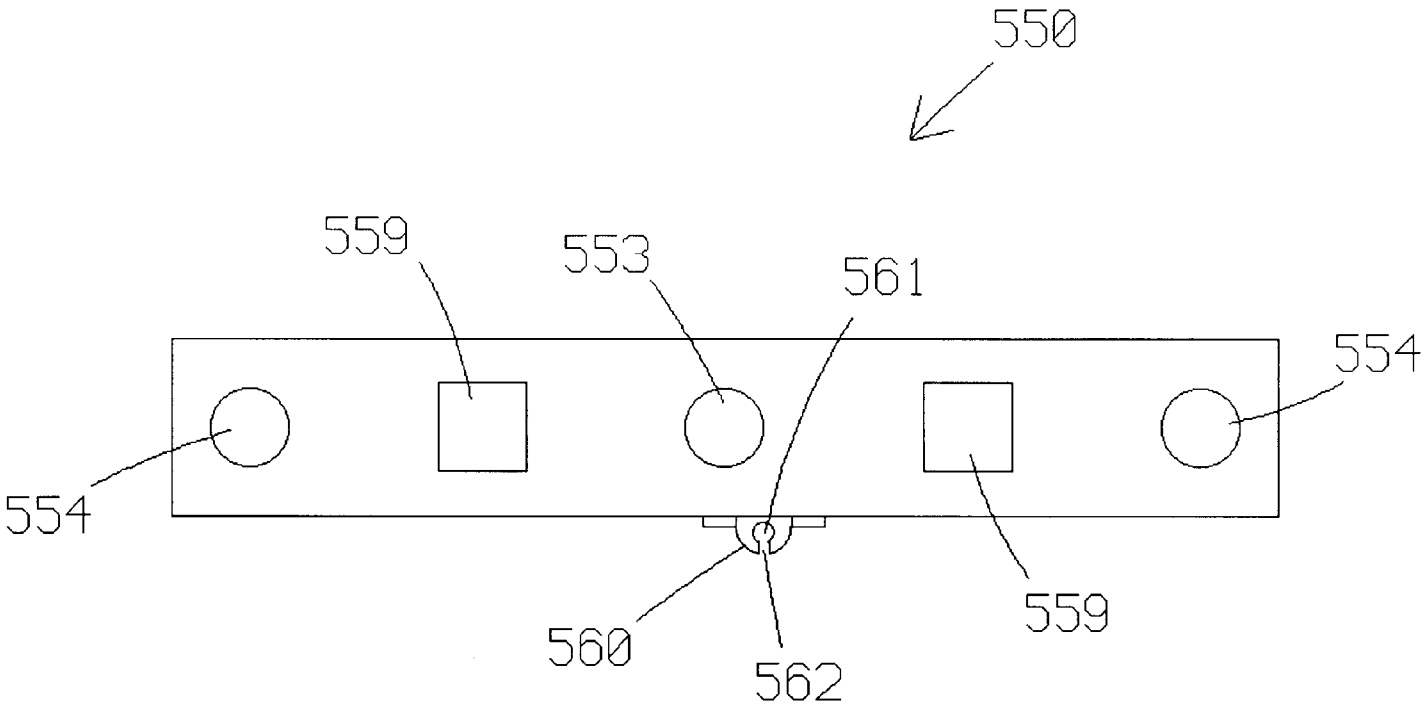
FIG. 11 is a bottom view of a supplemental weight on the exercise apparatus of FIG. 10.

Supplemental weights 550 are movably mounted on the guide rods 112*e* and 114*e* above the top plate 123*e*. As shown in FIG. 11, each weight 550 is a plate provided with a central hole 553 to accommodate the selector rod 130*e* and the cable 138*e*, and with opposite end holes 554 to accommodate the guide rods 112*e* and 114*e*. As suggested above, rubber pads 559 are mounted on the bottom of each of these weights 550 to provide a buffer between the weight 550 and the top plate 123*e*.

A bracket 560 is mounted on the front side of the lower weight 550 (by bolts, for example). The bracket 560 provides an upwardly concave or tapered opening 561 which is accessible via a vertical slot 562. A stop 564 having a conical shape is connected to the frame of the apparatus 500 by means of a flexible cord 566. A handle or ball 568 is connected to a distal end of the cord 566 to facilitate manipulation thereof. The cord 566 is sized and configured to pass through the slot 562, and the stop 564 is sized and configured to occupy the opening 561. The lower weight 550 is lowered onto the top plate 123*e* by pushing the weight 550 upward, pulling the respective cord 566 (toward the reader), and allowing the weight 550 to descend. The upper weight 550 is disengaged from the frame by moving the respective cord 566 away from the reader.

Figure 12:
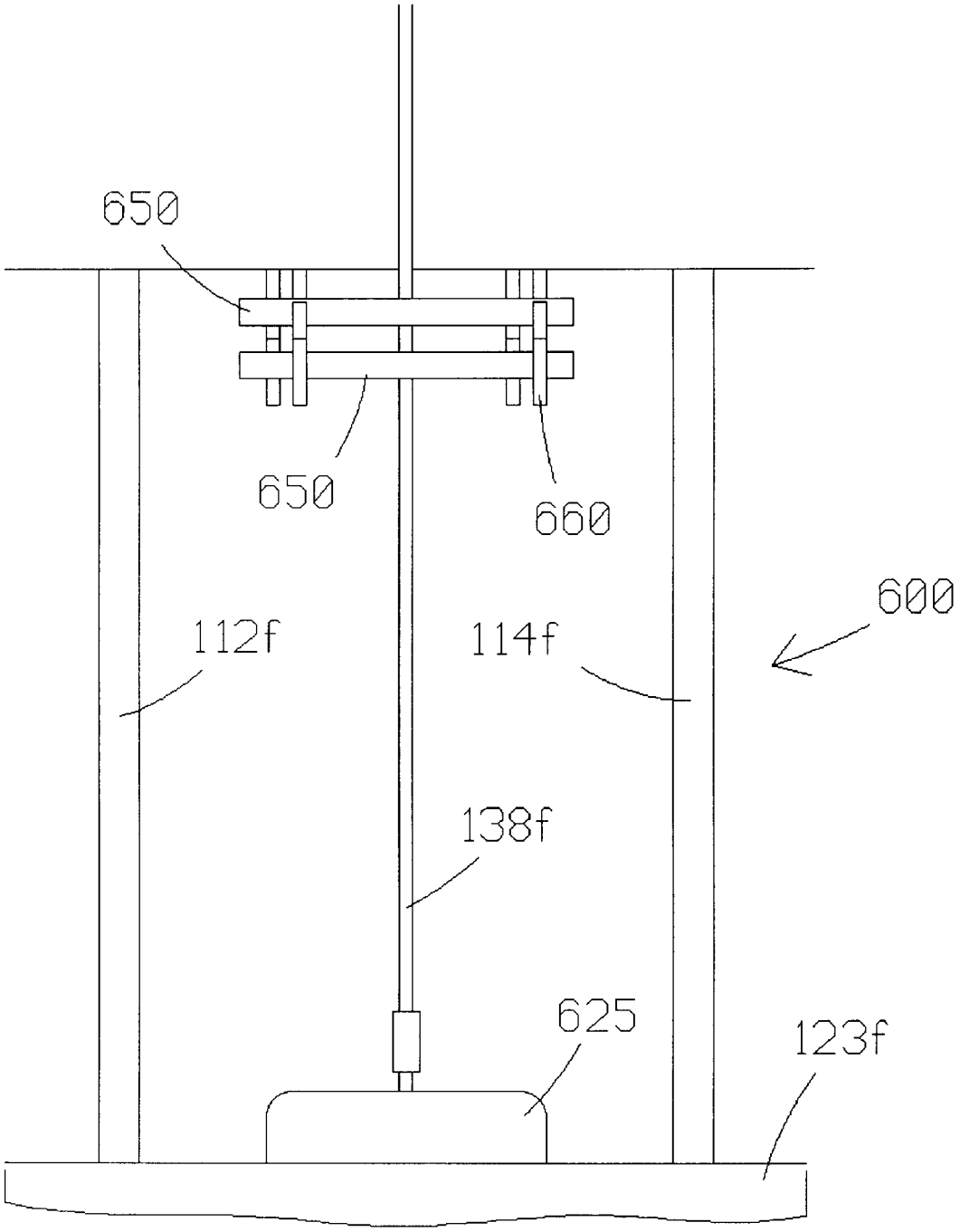
FIG. 12 is a partially fragmented, front view of a sixth exercise apparatus constructed according to the principles of the present invention.

FIG. 12 shows a sixth weight stack machine 600 which has been modified in accordance with the principles of the present invention. The machine 600 similarly includes a weight stack, including top plate 123*f*, movably mounted on guide rods 112*f* and 114*f*. A selector rod (not shown) extends through the weight stack and is connected to a force receiving member by means of cable 138*f*.

Supplemental weights 650 are selectively movable onto the top plate 123*f* along a path dictated by cable 138*f*. Each weight 650 forms a substantially closed loop about the cable 138*f*, while the guide rods 112*f* and 114*f* are disposed outside the loop. When lowered onto the top plate 123*f*, each weight 550 fits snugly about a block 625 on the top plate 123*f*.

Figure 13:
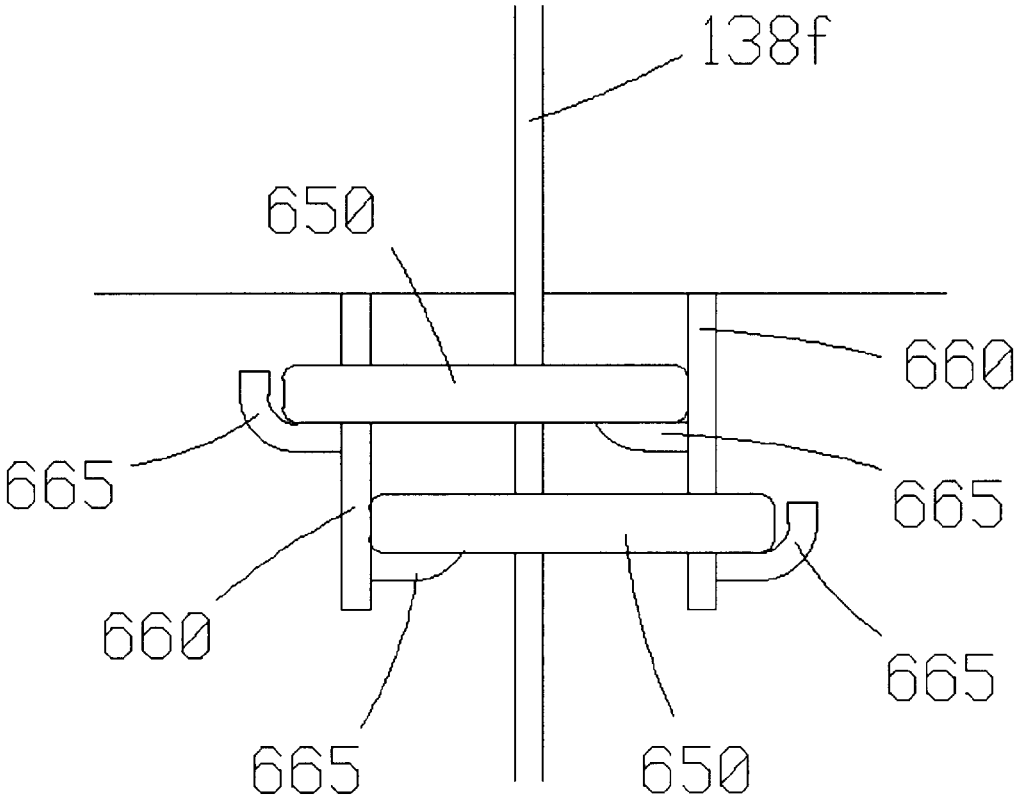
FIG. 13 is a side view of supports and supplemental weights on the exercise apparatus of FIG. 12.

Supports 660 are secured to the frame of the apparatus 600 and extend downward toward the top plate 123*f*. As shown in FIG. 13, the supports 660 provide hooks 665 to selectively retain the weights 650. The lower weight 650 is lowered onto the top plate 123*f* by first moving it upward and away from the reader and then moving it downward when free of the hooks 665. An advantage of this embodiment (and certain other embodiments described herein) is that the weights 650 do not engage the guide rods 112*f* and 114*f*, but are still connected to the apparatus 600.

Figure 14:
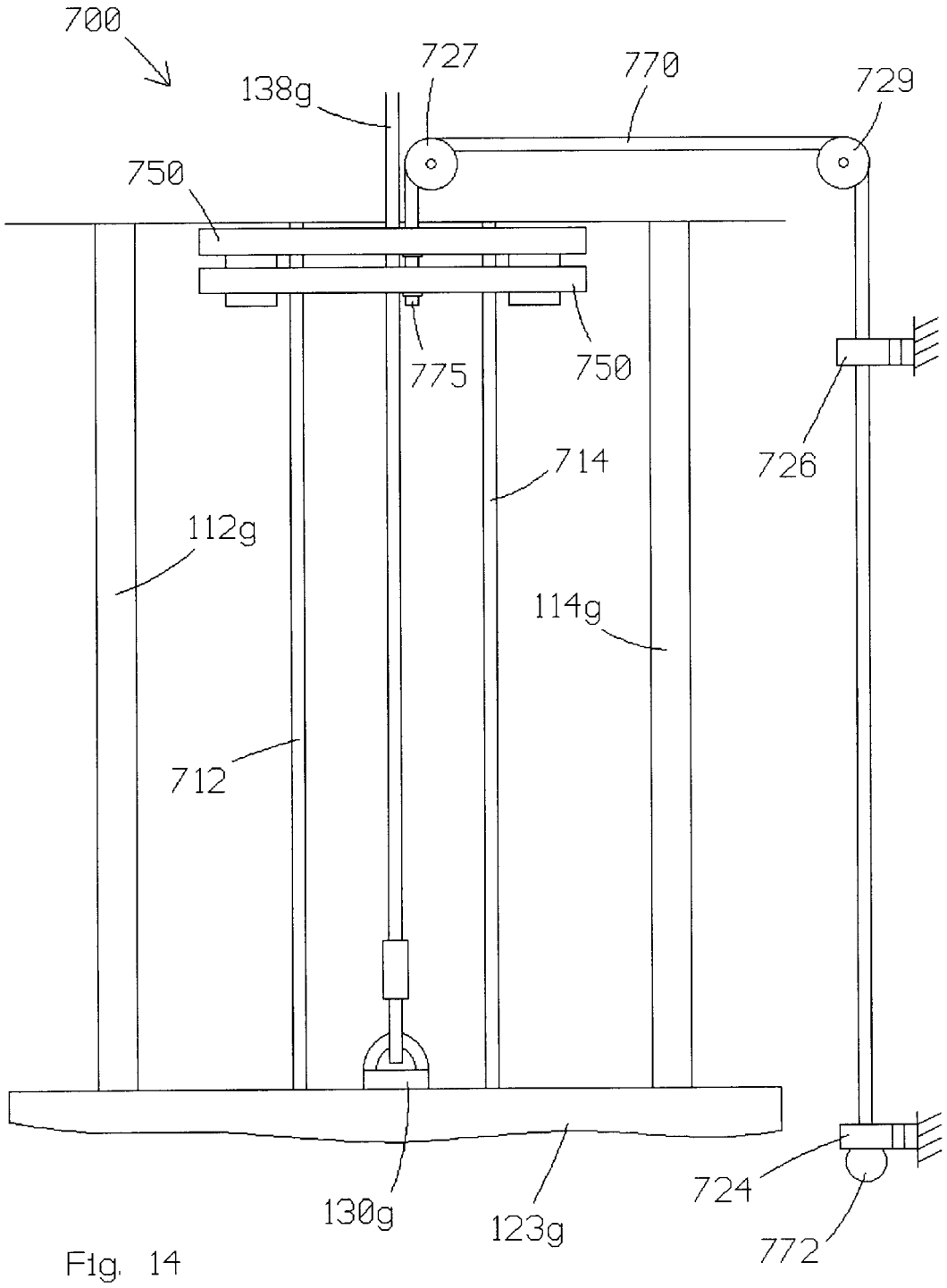
FIG. 14 is a partially fragmented, front view of a seventh exercise apparatus constructed according to the principles of the present invention.

FIG. 14 shows a seventh weight stack machine 700 which has been modified in accordance with the principles of the present invention. The machine 700 similarly includes a weight stack, including top plate 123*g*, movably mounted on guide rods 112*g* and 114*g*. A selector rod 130*g* extends through the weight stack and is connected to a force receiving member by means of cable 138*g*.

Supplemental weights 750 are selectively movable onto the top plate 123*g* along a path dictated by guide cords 712 and 714, which extend between the frame and the top plate 123*g* (independent of the guide rods 112*g* and 114*g*). In the alternative, the lower ends of the guide cords could be secured to a lower portion of the frame. In either case, each of the weights 750 is a plate having a central hole 753 to provide clearance for the cable 138*g* and the selector rod 130*g*. Diametrically opposed holes 756 are formed through the weight 750 to accommodate respective guide cords 712 and 714. Hole 751 is formed through the upper weight 750 to facilitate attachment of the upper weight 750 to a first support 770, and hole 752 is formed through the upper weight 750 to provide clearance for a second support 770 that is attached to the lower weight 750. Resilient bumpers 759 are mounted on the side of each weight 750 nearest the top plate 123*g*.

The supports 770 are connected to the frame of the apparatus 700 by pulleys 727 and 729 and brackets 724 and 726. A first end of one support 770 is threaded through the holes 752 in the weights 750 and secured to the lower weight 750 by a fastener 775. A first end of the other support 770 is threaded through the hole 751 in the upper weight 750 and secured thereto by another fastener 775. An opposite end of each support 770 is connected to a respective ball or handle 772 which is moved from the bracket 724 to the bracket 726 in order to lower a respective weight 750. An advantage of this embodiment is that the weights 750 may be lowered remotely. Moreover, the manually operated adjustment mechanism could be replaced by a motorized winch, for example, to facilitate automated weight adjustment.

Figure 16:
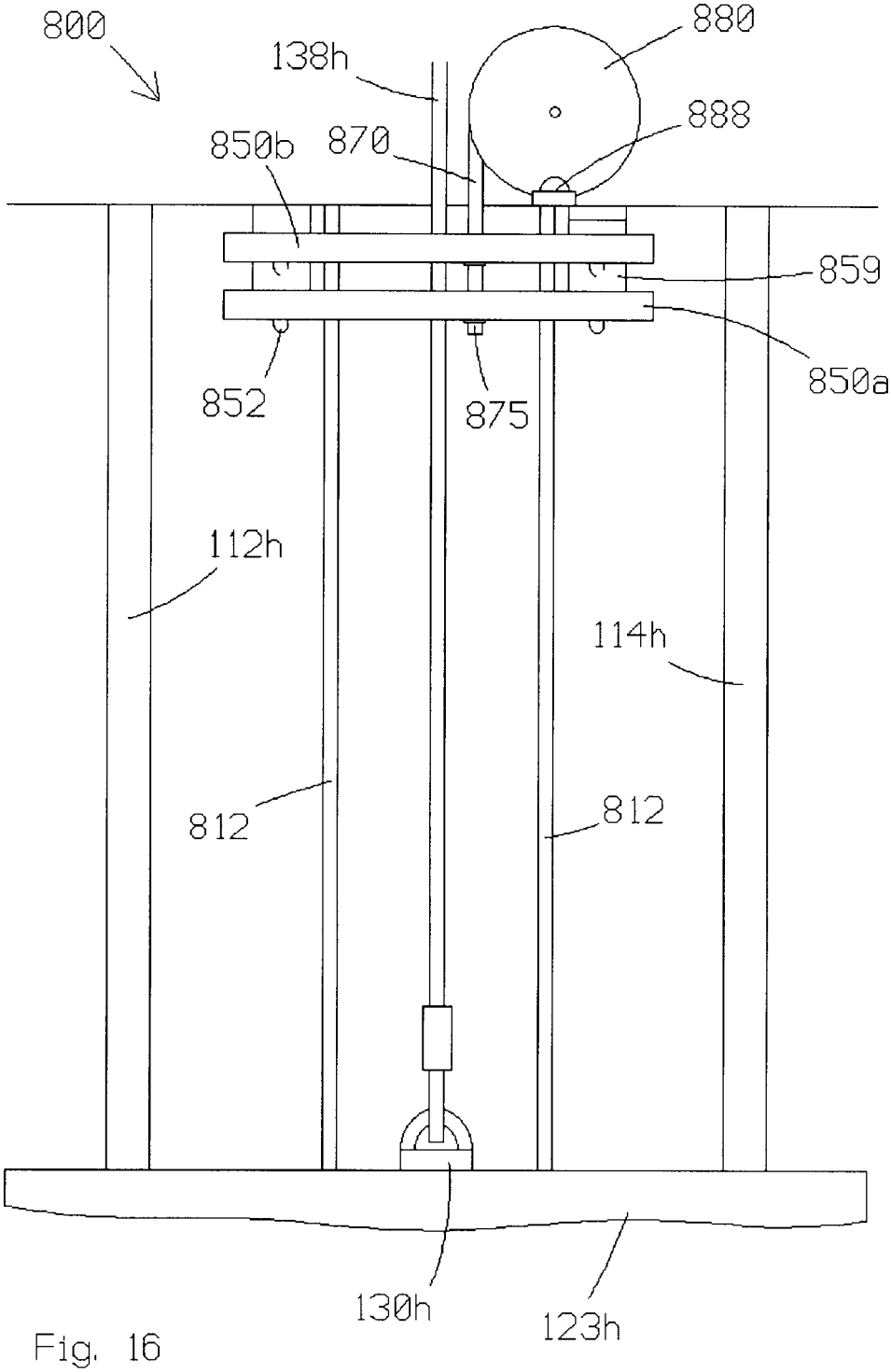
FIG. 16 is a partially fragmented, front view of an eighth exercise apparatus constructed according to the principles of the present invention.

FIG. 16 shows an eighth weight stack machine 800 which has been modified in accordance with the principles of the present invention. The machine 800 similarly includes a weight stack, including top plate 123*h*, movably mounted on guide rods 112*h* and 114*h*. A selector rod 130*h* extends through the weight stack and is connected to a force receiving member by means of cable 138*h*.

Figure 15:
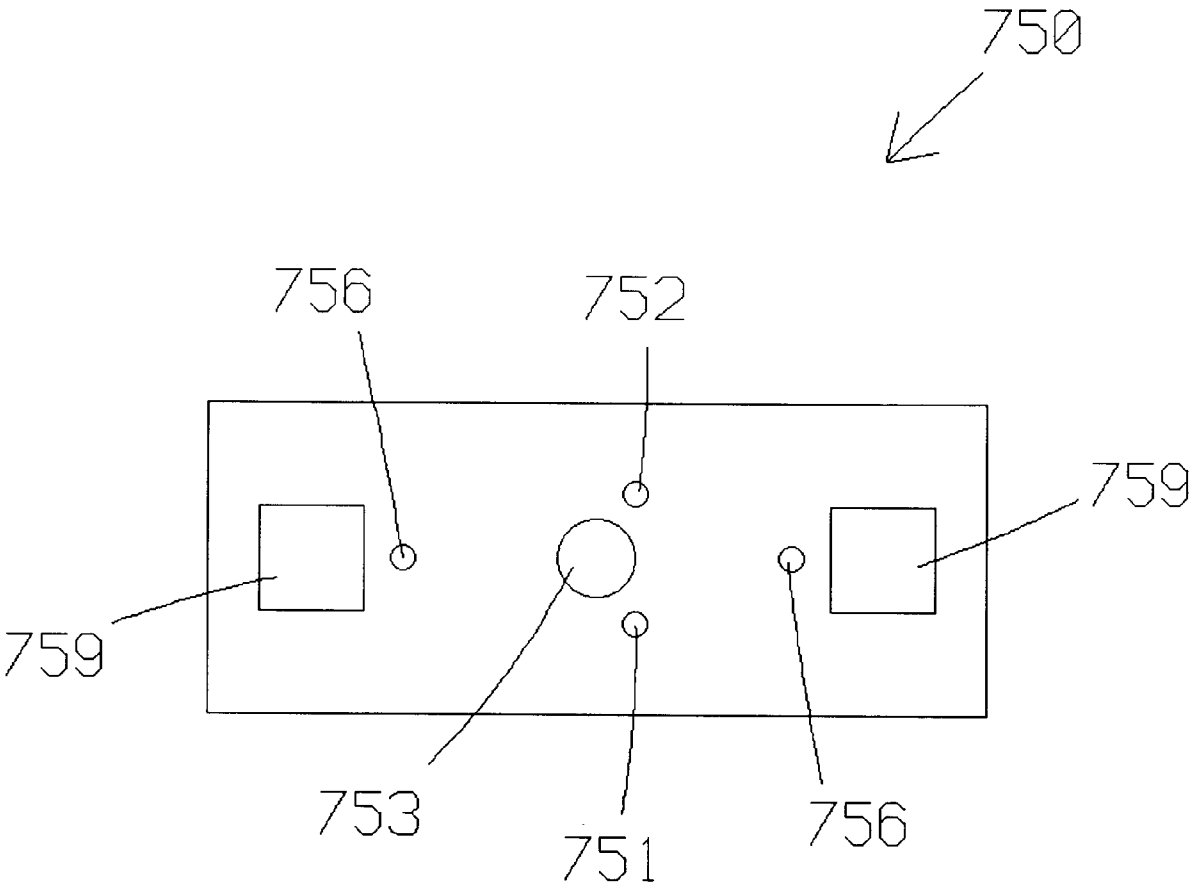
FIG. 15 is a bottom view of a supplemental weight on the exercise apparatus of FIG. 14.

Supplemental weights 850*a* and 850*b* are selectively movable onto the top plate 123*h* along a path dictated by guide cords 812, which extend between the top plate 123*h* and an upper portion of the frame. The weights 850*a* and 850*b* are similar to the weights 750 shown in FIG. 15, except that (a) relatively larger spacers 859 are disposed on a top side of each weight 850*a* or 850*b*; (b) pegs 852 extend downward from the weight 850*a* to selectively engage holes extending downward into the top plate 123*h*; and (c) holes extend downward into the weight 850*a* (or the spacers 859 on the weight 850*a*) to selectively receive pegs extending downward from the weight 850*b*.

For each of the weights 850*a* and 850*b*, a flexible cord 870 extends between the weight 850*a* or 850*b* and a respective spring-biased reel 880. A first end of each cord 870 is connected to a respective reel 880, and a second, opposite end of each cord 870 is connected to a respective weight 850*a* or 850*b* by means of a fastener 875. The spring force of the reel 880 is sufficiently strong to maintain the weight 850*a* or 850*b* in the raised position. The weight 850*a*, for example, is moved to the lowered position simply by pulling downward, as a latching mechanism 888 (such as a pivoting pawl, for example) releasably locks the reel 880 against rewinding. The latching mechanism 888 may be subsequently released to return the weight 850*a* upward.

An advantage of this embodiment is that the weights 850*a* and 850*b* are not prone to fall toward the top plate 123*h* and possibly cause bodily injury or damage to the machine 800. Those skilled in the art will recognize that a variety of other known counterbalances may substituted for the spring-biased reels 880.

Figure 17:
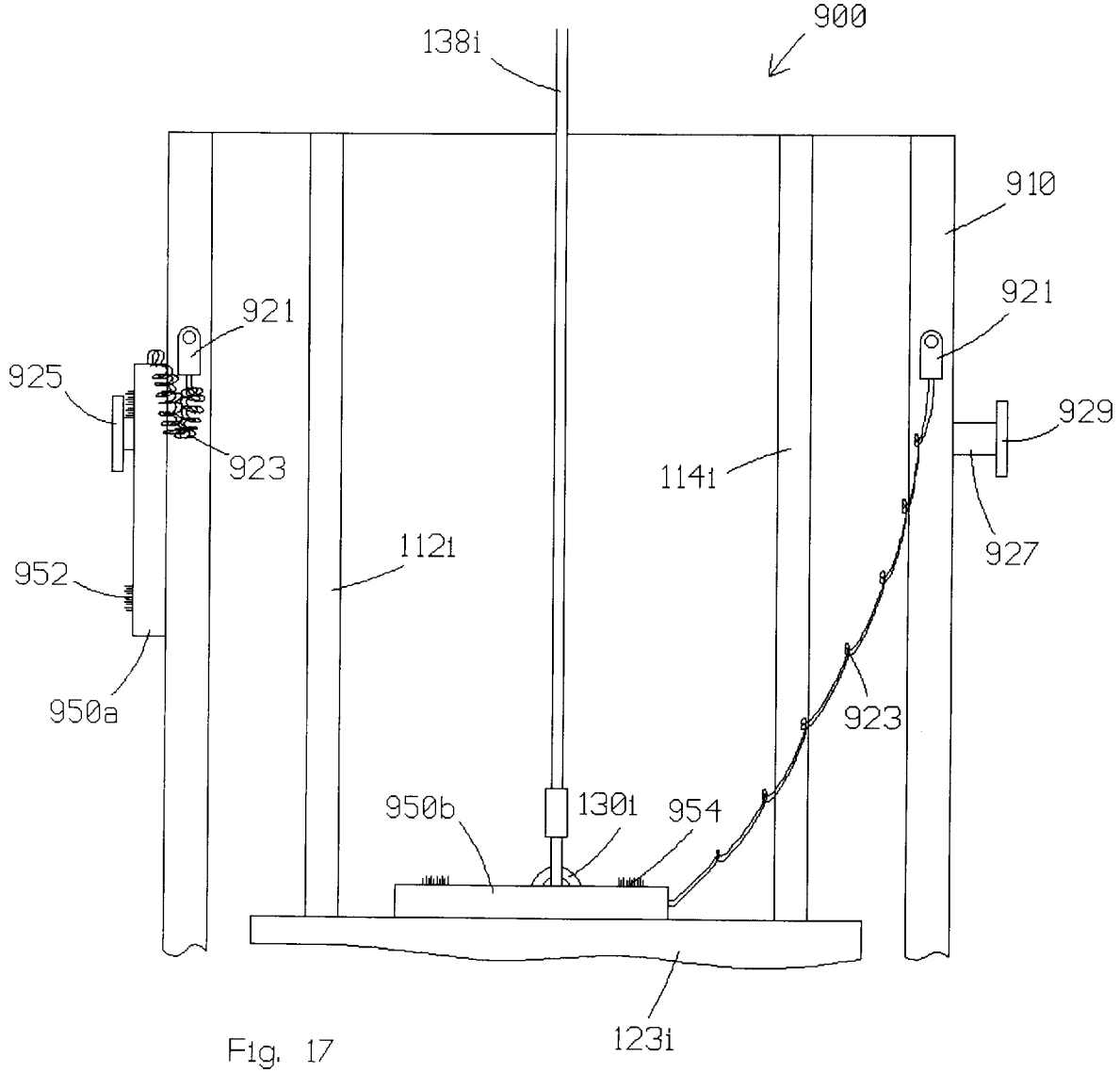
FIG. 17 is a partially fragmented, front view of a ninth exercise apparatus constructed according to the principles of the present invention.

FIG. 17 shows a ninth weight stack machine 900 which has been modified in accordance with the principles of the present invention. The machine 900 similarly includes a weight stack, including top plate 123*i*, movably mounted on guide rods 112*i* and 114*i*. A selector rod 130*i* extends through the weight stack and is connected to a force receiving member by means of cable 138*i*.

Figure 18:
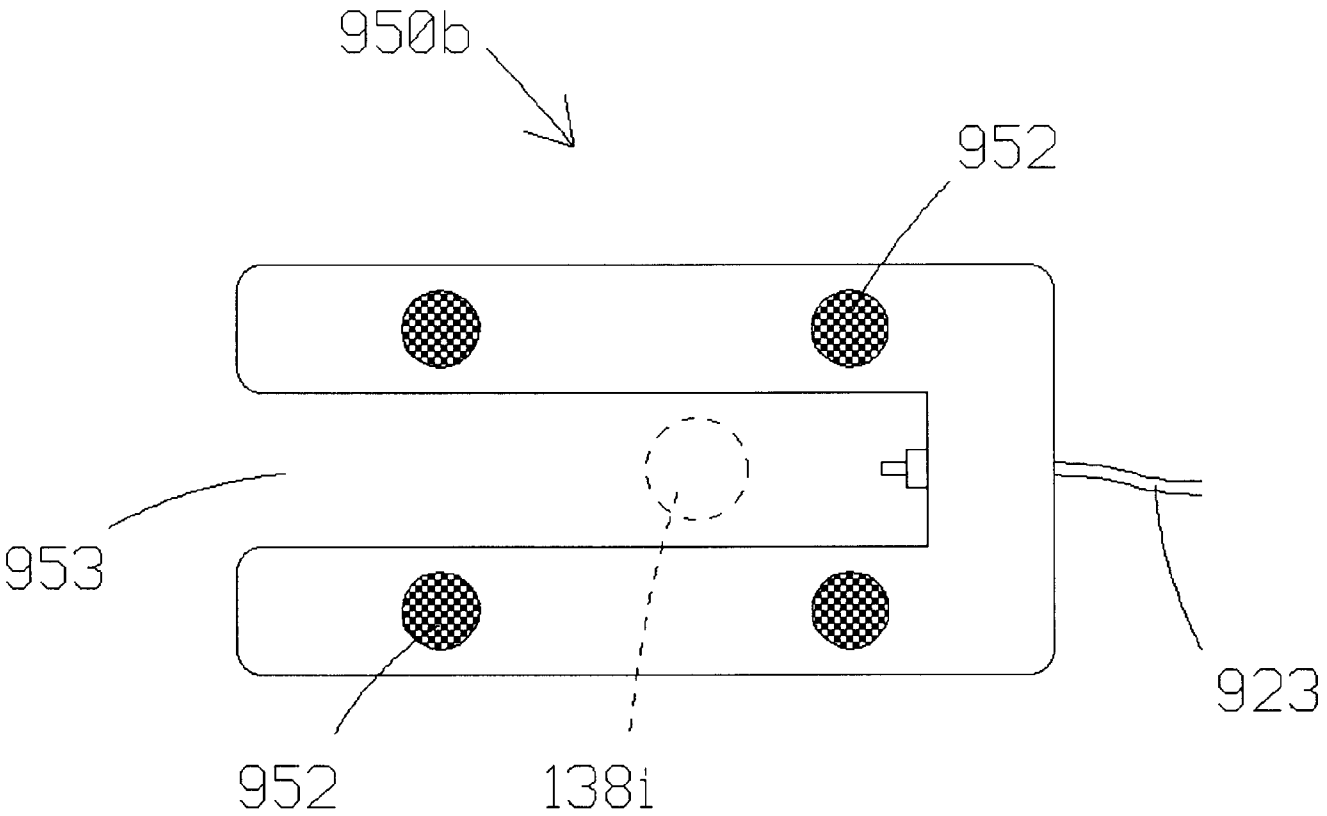
FIG. 18 is a bottom view of a supplemental weight on the exercise apparatus of FIG. 18.

Supplemental weights 950*a* and 950*b* are selectively movable onto the top plate 123*i* along a path limited by respective tethers 923, which extend between the frame 910 and respective weights 950*a* and 950*b*. As shown in FIG. 18, the weight 950*b* (which is representative of the weight 950*a*) is U-shaped to occupy a balanced position relative to the top plate 123*i*, and to provide clearance for the selector rod 138*i* inside slot 953. Hook type fasteners 952 are mounted on one side of the weight 950*b* to mate with loop type fasteners on the top plate 123*i*. Loop type fasteners 954 are mounted on an opposite side of the weight 950*b* to mate with hook type fasteners on the other plate 950*a* (which also has loop type fasteners on an opposite side, in case the two weights 950*a* and 950*b* are reversed).

The tethers 923 are similar to telephone cords which form a helical coil when free of tension. A first end of each tether 923 is secured to a respective weight 950*a* or 950*b*, and a second, opposite end of each tether 923 is secured to a respective bracket 921 pivotally mounted to the frame 910. Weight supports 925 are secured to the frame 910 to retain the weights 950*a* and 950*b* when not in use. Each support 925 includes a square shaft 927 which fits into the slot 953 in either weight 950*a* or 950*b*, and a flange 929 which spans a portion of either weight 950*a* or 950*b*. Other suitable supports may be used to retain the weights 950*a* and 950*b* on the frame directly above the top plate 123*i*.

The foregoing description and/or the claims set forth below use certain terms which should be construed along the following lines to the extent necessary to overcome any relevant prior art. The lowermost and uppermost positions of the top plate in the weight stack are defined with reference to all parts and/or portions which are rigidly secured thereto. The space defined between these positions is bordered vertically by the positions themselves and horizontally by the planform of the top plate. The substantially fixed path which is said to be traversed by the supplemental weight is limited in length to the height of the machine and includes the lowermost and uppermost positions of the top plate. The substantially closed loop which is said to be formed about the cable and/or one or more guide rods includes any closed curve not having a break or gap greater in width than the part(s) enclosed within the curve.

The foregoing description references specific embodiments but will enable those skilled in the art to recognize additional improvements and/or combinations. For example, the supplemental weights may be secured to the frame and/or to the top plate by relatively more complicated arrangements which nonetheless incorporate the essence of the present invention. Also, features of one embodiment may be suitable for use on another embodiment, either alone or in combination with features from still other embodiments. For example, hook and loop fasteners may be used to releasably fasten any of the supplemental weights to their respective top plates. In view of the foregoing, the scope of the present invention is to be limited only to the extent of the following claims.

What is claimed is:

1. An exercise apparatus, comprising:

a frame including a guide rod having a rigid support rigidly connected to the guide rod and extending radially outward from the guide rod;

a stack of weight plates, including a top plate, mounted on the guide rod for movement between a lowermost position and an uppermost position, wherein the uppermost position is beneath the rigid support;

a connector for interconnecting a force receiving member and a desired number of plates in the stack; and a supplemental weight mounted on the guide rod for movement between a first location for storage, entirely above the uppermost position, and a second location for supplementing the weight of the weight stack, entirely beneath the uppermost position, wherein at least a portion of the supplemental weight overlies the rigid support to maintain the supplemental weight in the first location.

2. The exercise apparatus of claim 1, wherein the supplemental weight is rotatable relative to the frame between a first orientation, engaged by the rigid support, and a second orientation, clear of the rigid support.

3. The exercise apparatus of claim 2, wherein the rigid support is a pin extending transverse to the guide rod, and a transverse slot through the supplemental weight aligns with the pin when the supplemental weight occupies the second orientation.

4. The exercise apparatus of claim 3, wherein a transverse groove in the supplemental weight aligns with the pin when the supplemental weight occupies the first orientation.

5. The exercise apparatus of claim 2, wherein the frame includes a first guide rod and a second guide rod, and each said guide rod extends through the plates, and one said supplemental weight is movably mounted on the first guide rod, and another said supplemental weight is movably mounted on the second guide rod.

6. The exercise apparatus of claim 2, wherein the frame includes a first guide rod and a second guide rod extending through the plates, and a first end of the supplemental weight is rotatably mounted on the first guide rod, and a second, opposite end of the supplemental weight is movable into and out of engagement with a rigid support on the second guide rod.

7. The exercise apparatus of claim 6, wherein the first end of the supplemental weight forms a substantially closed loop about the first guide rod.

8. The exercise apparatus of claim 6, wherein the supplemental weight forms a substantially closed loop about both the first guide rod and the second guide rod.

9. A method of adjusting weight resistance on an exercise apparatus, comprising the steps of:

providing a frame with an interior space bounded by a shield;

providing a stack of weight plates, including a top plate, movable relative to the frame between a lowermost position and an uppermost position inside the interior space;

providing a connector interconnected between a force receiving member, disposed outside the interior space, and a desired number of plates in the stack;

providing a supplemental weight above the stack and movable relative to the frame between a first storage position and a second position inside the interior space for supplementing the weight of the weight stack, wherein the first position is above the uppermost position, and the second position is beneath the uppermost position;

providing a handle connected to the supplemental weight and movable relative to the frame between a first position and a second position outside the interior space; and selectively moving the handle from the first position to the second position outside the interior space in order to move the supplemental weight from the first position to the second position inside the interior space.

10. The exercise apparatus of claim 1, wherein the rigid support is a pin extending transverse to the guide rod, and a transverse slot through the supplemental weight aligns with the pin to accommodate movement of the supplemental weight from the first location to the second location.

11. The exercise apparatus of claim 10, wherein a transverse groove in the supplemental weight aligns with the pin and cooperates with gravity acting on the supplemental weight to bias the supplemental weight to remain in the first position.

12. The exercise apparatus of claim 1, wherein a handle is connected to the supplemental weight, and a shield is connected to the frame in such a manner that the handle and the weight are disposed on opposite sides of the shield.

13. The exercise apparatus of claim 1, wherein the support includes at least one hook sized and configured to engage the supplemental weight.

14. The exercise apparatus of claim 1, wherein a shock absorbing material is connected to a side of the supplemental weight nearest the top plate.

15. The exercise apparatus of claim 1, wherein the top plate and the supplemental weight are configured to remain in a particular position relative to one another when the supplemental weight occupies the second location.

16. The exercise apparatus of claim 1, wherein the supplemental weight forms a substantially closed loop about the connector.

17. An exercise apparatus, comprising:

a frame including a first guide rod having a first radially extending support rigidly secured thereto, and a second guide rod having a second radially extending support rigidly secured thereto;

a stack of weight plates, including a top plate, mounted on both the first guide rod and the second guide rod for movement between a lowermost position and an uppermost position, wherein the uppermost position is beneath both the first radially extending support and the second radially extending support;

a connector for interconnecting a force receiving member and a desired number of plates in the stack;

supplemental weights for supplementing the weight of the weight stack, including a first supplemental weight movably mounted on at least the first guide rod and a second supplemental weight movably mounted on at least the second guide rod, wherein at a first position above the uppermost position, the first axially extending support cooperates with the first supplemental weight to selectively support the first supplemental weight, and at a second position above the uppermost position, the second axially extending support cooperates with the second supplemental weight to selectively support the second supplemental weight.

18. The exercise apparatus of claim 17, wherein each said supplemental weight defines an opening which selectively receives a respective axially extending support.

19. The exercise apparatus of claim 18, wherein each said guide rod is disposed inside a respective opening.

20. A method of adjusting weight resistance on an exercise apparatus, comprising the steps of:

providing a frame with a first guide rod having a first rigid support which is rigidly secured to the first guide rod and extends radially outward from the first guide rod, and with a second guide rod having a second rigid support which is rigidly secured to the second guide rod and extends radially outward from the second guide rod;

providing a stack of weight plates, including a top plate, mounted on both the first guide rod and the second guide rod for movement between a lowermost position and an uppermost position beneath both the first rigid support and the second rigid support and supplementing the weight of the weight stack;

providing a connector interconnected between a force receiving member and a desired number of plates in the stack;

providing a first supplemental weight mounted on at least the first guide rod for movement along the first guide rod;

providing a second supplemental weight mounted on at least the second guide rod for movement along the second guide rod;

selectively maneuvering the first supplemental weight from a first upper position, resting on the first rigid support, to a first lower position, disposed entirely beneath the first rigid support; and selectively maneuvering the second supplemental weight from a second upper position, resting on the second rigid support, to a second lower position, disposed entirely beneath the second rigid support and supplementing the weight of the weight stack.

21. The method of claim 20, wherein each said supplemental weight is provided with an opening, and each said maneuvering step involves arranging the opening to accommodate a respective rigid support and then moving a respective supplemental weight axially along a respective guide rod.

22. The method of claim 20, wherein each said maneuvering step involves moving at least a portion of a respective supplemental weight radially relative to a respective guide rod.

23. The method of claim 20, wherein the maneuvering step involving the first supplemental weight is performed without touching anything but the first supplemental weight.

* * * * *